US007506922B2

(12) United States Patent
Schulte et al.

(10) Patent No.: US 7,506,922 B2
(45) Date of Patent: Mar. 24, 2009

(54) RECONFIGURABLE CHILD RECEIVING ROCKER DEVICE

(75) Inventors: Anthony G. Schulte, East Aurora, NY (US); Michael D. Armbruster, Grand Island, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 11/745,543

(22) Filed: May 8, 2007

(65) Prior Publication Data

US 2007/0257534 A1 Nov. 8, 2007

Related U.S. Application Data

(60) Provisional application No. 60/798,303, filed on May 8, 2006.

(51) Int. Cl.
*A47C 3/029* (2006.01)
*A47D 13/10* (2006.01)

(52) U.S. Cl. ..... 297/131; 297/270.2; 297/271.6; 297/272.1

(58) Field of Classification Search ..... 297/130, 297/131, 132, 270.2, 270.3, 270.4, 270.5, 297/271.6, 272.1; 5/105, 106
See application file for complete search history.

(56) References Cited

U.S. PATENT DOCUMENTS

| | | | | |
|---|---|---|---|---|
| 055,401 | A | 6/1866 | Warren | |
| 190,417 | A | 5/1877 | Bushong | |
| 394,010 | A | 12/1888 | Powers | |
| 584,529 | A * | 6/1897 | Starcher | 297/131 |
| 808,822 | A * | 1/1906 | Dunn | 297/11 |
| 1,994,954 | A | 3/1935 | Krueger | |
| 2,293,560 | A * | 8/1942 | Price | 280/31 |
| 2,417,618 | A | 3/1947 | Scott | |
| 2,558,466 | A | 6/1951 | Simard et al. | |
| 2,560,963 | A * | 7/1951 | Kornegay | 472/135 |
| 2,658,753 | A | 11/1953 | Dawson | |

(Continued)

*Primary Examiner*—David Dunn
*Assistant Examiner*—Patrick Lynch
(74) *Attorney, Agent, or Firm*—Edell, Shapiro & Finnan, LLC

(57) ABSTRACT

The present invention relates to a reconfigurable child receiving device that includes a seat portion and arcuate leg members that support the seat portion above a supporting surface. The seat portion is further supported by arcuate cross members that extend between the leg members and are pivotally connected to the leg members. The arcuate cross member can each be individually pivoted upward above the leg members or downward below the leg members. The pivotal connection between the leg members and the cross members enables the reconfigurable child receiving device to be configured into four different modes of use. In a first mode, both arcuate cross members are pivoted upward above the leg members to allow the device to rock on the leg members in a first direction. In a second mode the second cross member is pivoted downward to prevent rocking in the first direction and to secure the seat portion in a relatively upright configuration. In a third mode the first arcuate cross member is pivoted downward to prevent the device from rocking in the first direction and to support the seat portion in a generally reclined position. In a fourth mode, both arcuate cross members are pivoted downward below the leg members and into contact with the supporting surface to enable the device to rock in a second direction, the second direction being generally perpendicular to the first direction.

22 Claims, 6 Drawing Sheets

U.S. PATENT DOCUMENTS

| | | | | |
|---|---|---|---|---|
| 2,854,062 | A | 9/1958 | Hetchler | |
| 3,047,333 | A | 7/1962 | Stanimir | |
| 4,047,753 | A * | 9/1977 | Uchida | 297/32 |
| 4,993,703 | A | 2/1991 | Sears | |
| 5,016,301 | A | 5/1991 | Combs | |
| 5,178,438 | A | 1/1993 | Beger | |
| 5,265,932 | A | 11/1993 | Leonard | |
| 5,490,711 | A | 2/1996 | Pollock | |
| 5,588,164 | A | 12/1996 | Proulx | |
| D388,621 | S | 1/1998 | Reese | |
| 5,887,945 | A | 3/1999 | Sedlack | |
| 6,024,409 | A * | 2/2000 | Collins | 297/271.6 |
| 6,540,292 | B2 | 4/2003 | Darling et al. | |
| D480,884 | S | 10/2003 | Kane et al. | |
| 6,679,779 | B2 | 1/2004 | Tai et al. | |
| D491,736 | S | 6/2004 | Kane et al. | |
| 6,811,217 | B2 | 11/2004 | Kane et al. | |
| 7,252,333 | B2 * | 8/2007 | Caldwell | 297/259.2 |

* cited by examiner

RECONFIGURABLE CHILD RECEIVING ROCKER DEVICE

CROSS-REFERENCE TO RELATED APPLICATIONS

This application claims priority under 35 U.S.C. §119(e) to U.S. Provisional Patent Application Ser. No. 60/798,303, entitled "RECONFIGURABLE CHILD RECEIVING ROCKER DEVICE" and filed May 8, 2006, the disclosure of which is incorporated herein by reference in its entirety.

BACKGROUND OF THE INVENTION

The present invention relates to a seat supported by arcuate leg members on which the seat may rock back and forth in a first direction. More particularly, the legs of the child receiving seat of the present invention include arcuate, pivotable, cross members that pivot relative to the leg members to allow the rocker to rock in multiple directions.

Young children have a need to be physically stimulated. Gentle rocking in a parent's arms is one of the most basic parental stimulations. In order to provide relief to a parent from the continuous holding and rocking of a child, some child receiving devices simulate the motion of a parent's arms. Child receiving devices such as rockers generally include curved support members that support the seat portion of the rocker above a supporting surface on which the curved support members rock. Some rocking seats rock from front to back while others rock from side to side. Likewise, some children prefer front to back rocking, while others prefer side to side rocking, and still others enjoy both types of rocking at different times.

There is therefore a need to develop a rocking seat that can provide both a front-to-back rocking motion as well as a side-to-side rocking motion. Furthermore, there is a need to provide a rocking seat that is easily convertible between a front-to-back rocking mode and side-to-side rocking mode.

SUMMARY OF THE INVENTION

Generally, the present invention discloses a reconfigurable child receiving rocking seat device including a seat portion and a plurality of leg members that rockingly support the seat portion on a supporting surface. The leg members each include an arcuate portion that contacts the supporting surface as the seat portion rocks back and forth. The leg members also each include a seat connector that pivotally connects each leg member to the seat portion and to a toy bar. The seat connector allows the seat portion and the toy bar to pivot relative to the leg members enabling the seat to be reclined and to allow the toy bar to be pivoted out of the way when placing a child into the seat portion.

The child receiving device of the present invention also includes a first arcuate cross member and a second arcuate cross member each of which are pivotally connected to the arcuate leg members. The first and second arcuate cross members can be individually pivoted to enable a parent to reconfigure the child receiving device of the present invention into four distinct useful modes of operation.

The unique pivotal arrangement and connection between the first and second cross members and the arcuate leg members facilitates the ease of reconfiguration between modes of operation. The first and second cross members extend between the leg members in a lateral direction that is perpendicular to the leg members. The first and second cross members also pivot about an axis perpendicular to the leg members. Each of the first and second cross members includes an arcuate portion. Each of the first and second cross members also has a first position in which the arcuate portion is positioned above the leg member and a second position in which the arcuate portion extends below the leg member. Reconfiguration, between the four modes of operation, therefore, only requires a pivoting movement of one or both of the first and second cross members into their first and second positions.

In the first mode of operation, the cross members are both pivoted upward (to their first position) to dispose the arcuate portions of the cross members in a position above the arcuate portions of the leg members. Also in the first mode of operation, the arcuate portions of the leg members contact the supporting surface to allow the seat portion to rock back and forth as the arcuate portions of the leg members rock back and forth on the supporting surface. In the second mode of operation, the second cross member is pivoted downward to its second position (while the first cross member remains in its upward position) so that the arcuate portion of the second cross member extends below the leg members. The downward extension of the arcuate portion of the second cross member below the arcuate portion of the leg members prevents the child receiving device from rocking back and forth along the arcuate portions of the leg members. Furthermore, the arcuate portion of the second cross member holds the rear portion of the child receiving device in an elevated position and therefore maintains the seat portion in a relatively upright, non-rocking, sitting position.

In the third mode of operation, the first cross member is pivoted downward (while the second cross member remains in its upward position) so that the arcuate portion of the first cross member extends below the arcuate portion of the leg members. The downward extension of the arcuate portion of the first cross member below the arcuate portions of the leg members prevents the child receiving device from rocking back and forth along the arcuate portions of the leg members. Furthermore, the arcuate portion of the first cross member holds the front portion of the child receiving device in an elevated position and therefore maintains the seat portion in a relatively reclined, non-rocking, lay-down position. Finally, in the fourth mode of operation, the cross members are both pivoted downward to dispose the arcuate portions of the first and second cross members in a position below the arcuate portions of the leg members. In this fourth mode of operation, the arcuate portions of the first and second cross members contact the supporting surface to allow the seat portion to rock from side to side as the arcuate portions of the first and second cross rockers roll on the support surface. In this mode of operation, the arcuate portions of the leg members are elevated above and do not contact the supporting surface.

In other words, in the first mode of operation, the cross members are pivoted upward for front-to-back rocking (on the arcuate portions of the leg members). In the second mode of operation, the second cross member is pivoted downward to maintain the seat portion in a relatively upright, non-rocking, sitting position. In the third mode of operation, the first cross member is pivoted downward (while the second cross member remains in its upward position) to maintain the seat portion in a relatively reclined, non-rocking, lay-down position. In the fourth mode of operation, the first and second cross members are both pivoted downward such that the arcuate portions of the leg members are suspended above the supporting surface and the arcuate portions of the cross members contact the supporting surface to provide a side-to-side rocking configuration. As a result, the child receiving device of the present invention can easily be converted between a front-to-back rocking configuration, a non-rocking relatively upright configuration, a non-rocking relatively reclined configuration, and a side-to-side rocking configuration.

BRIEF DESCRIPTION OF THE DRAWINGS

Like reference numerals have been used to identify like elements throughout this disclosure.

DETAILED DESCRIPTION OF THE INVENTION

In accordance with the present invention, a reconfigurable child receiving device is disclosed. The child receiving device includes a first configuration in which the cross members are pivoted upward for front-to-back rocking, a second configuration wherein the second cross member is pivoted downward (while the first cross member remains in its upward position) for a relatively upright, non-rocking configuration, a third mode in which the first cross member is pivoted downward (while the second cross member remains in its upward position) for a relatively reclined, non-rocking, lay-down configuration, and a fourth, side-to-side rocking configuration (wherein first and second cross members are pivoted downward such that the arcuate portions of the cross members contact the supporting surface).

Figure 1:
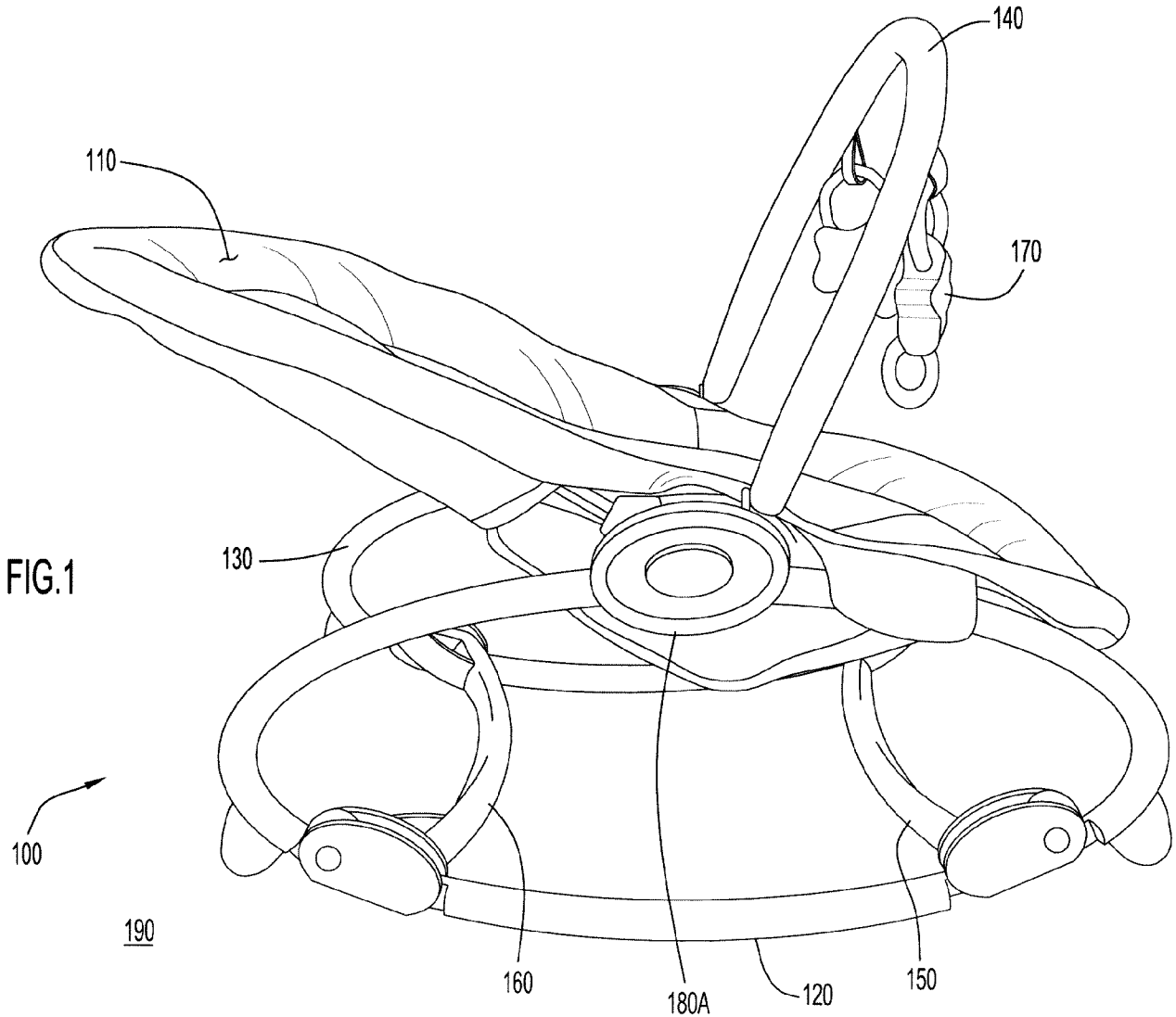
FIG. 1 illustrates a side perspective view of the child receiving device of the present invention in the front-to-back rocker configuration.

FIG. 1 illustrates a side perspective view of the reconfigurable child receiving device 100 of the present invention in the front-to-back rocker configuration. The child receiving device 100 includes a seat portion 110 for receiving a child (not shown) therein. The child receiving device 100 also includes a first leg member 120 and second leg member 130 for supporting the seat member 110 above a supporting surface 190. First and second cross members 150, 160 are pivotally connected to leg members 120, 130. The leg members 120, 130 support a seat connector 180. The seat connector 180 connects the leg members 120, 130 to the seat portion 110. The seat connector 180 also connects the leg members 120, 130 to a toy bar 140 which includes a plurality of toys 170 suspended therefrom.

Figure 2:
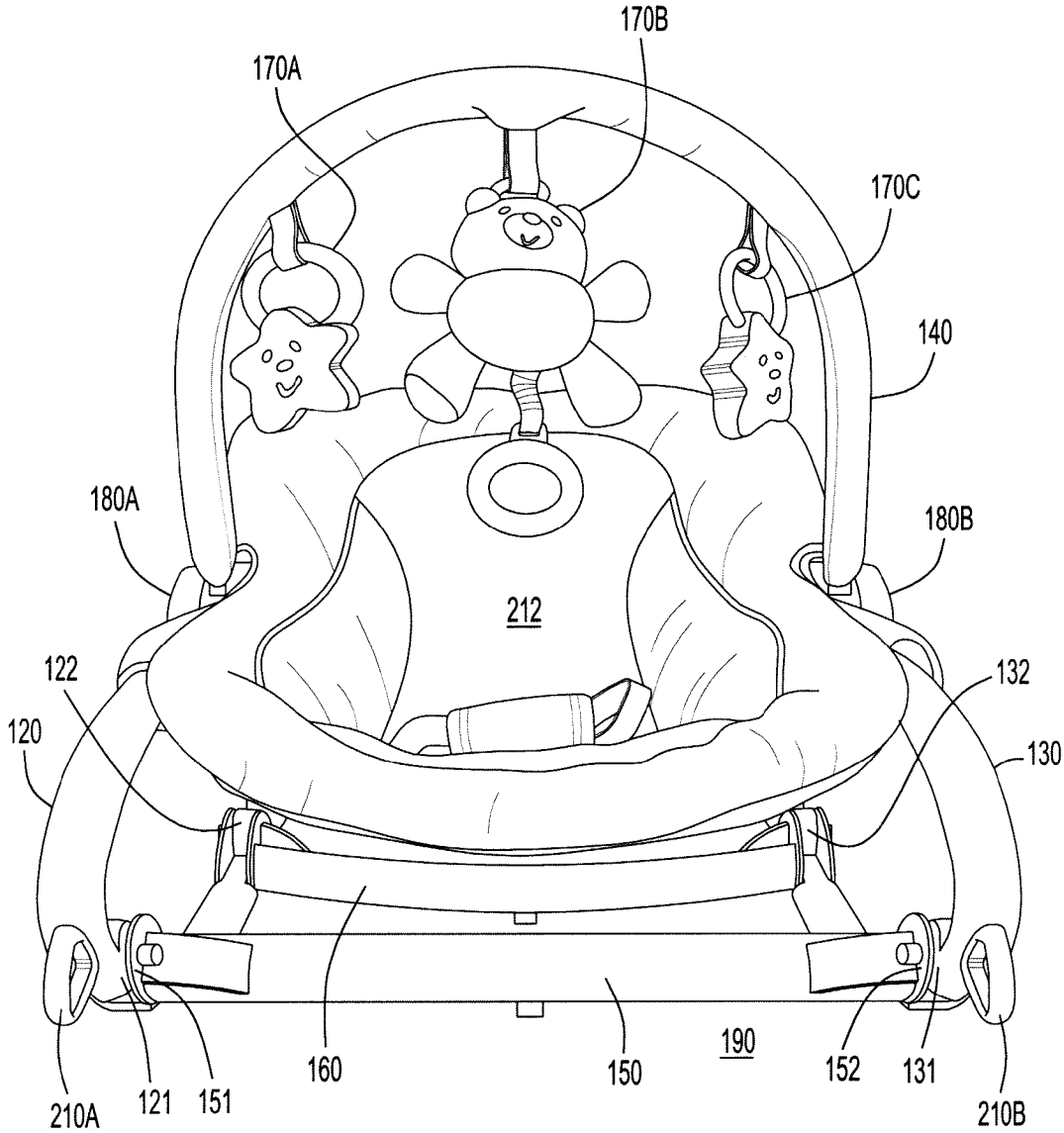
FIG. 2 illustrates a front view of the child receiving device of FIG. 1 in the front-to-back rocker configuration.

FIG. 2 illustrates a front view of the child receiving device 100 of the present invention in the front-to-back rocker mode. The seat portion 110 is designed for supporting a child therein and is composed of a hard frame (not shown) covered by a soft goods seat support 212. The seat portion 110 is also pivotally connected to the seat connector 180A, 180B to allow the seat portion 110 to be repositioned (reclined) relative to the leg members 120, 130.

In the illustrated embodiment, the leg members 120, 130 have a generally continuous oval shape. However, the leg members 120, 130 can be of any shape as long as they support the seat portion 110 above the supporting surface 190 and include an arcuate portion that rockingly contacts the supporting surface 190. The seat connectors 180A, 180B are connected at the upper portions of the leg members 120, 130. The seat connectors 180A, 180B, however, need not be connected at any particular portion of the leg members 120, 130, as long as they securely position the seat portion 110 on the leg members 120, 130 and the seat portion 110 does not interfere with the pivoting of the cross members 150, 160.

The toy bar 140 is also pivotally supported by the seat connectors 180A, 180B. The toy bar 140 may be either pivoted downward or upward out of the way so that a parent can place a child in the seat portion 110 unobstructed by the toy bar 140. The toy bar 140 may be pivoted back into the illustrated position after the child is placed in the seat portion 110. The ideal positioning of the toy bar 140 will place the suspended toys 170A-C within easy reach of the child in the seat portion 110.

The child receiving device 100 includes a first cross member 150 and a second cross member 160. The first and second cross members 150, 160 have first and second ends 151, 152 and 161, 162 respectively that extend between the lower portions of the leg members 120, 130. Each of the cross member first and second ends 151, 152 and 161, 162 are pivotally connected to pivotal leg connectors 121, 131, 122, 132 of the leg members 120, 130. In other words, cross member 150 pivots about an axis that passes through pivotal leg connectors 121 and 131 and cross member 160 pivots about an axis that passes through pivotal leg connectors 122 and 132.

Figure 5:
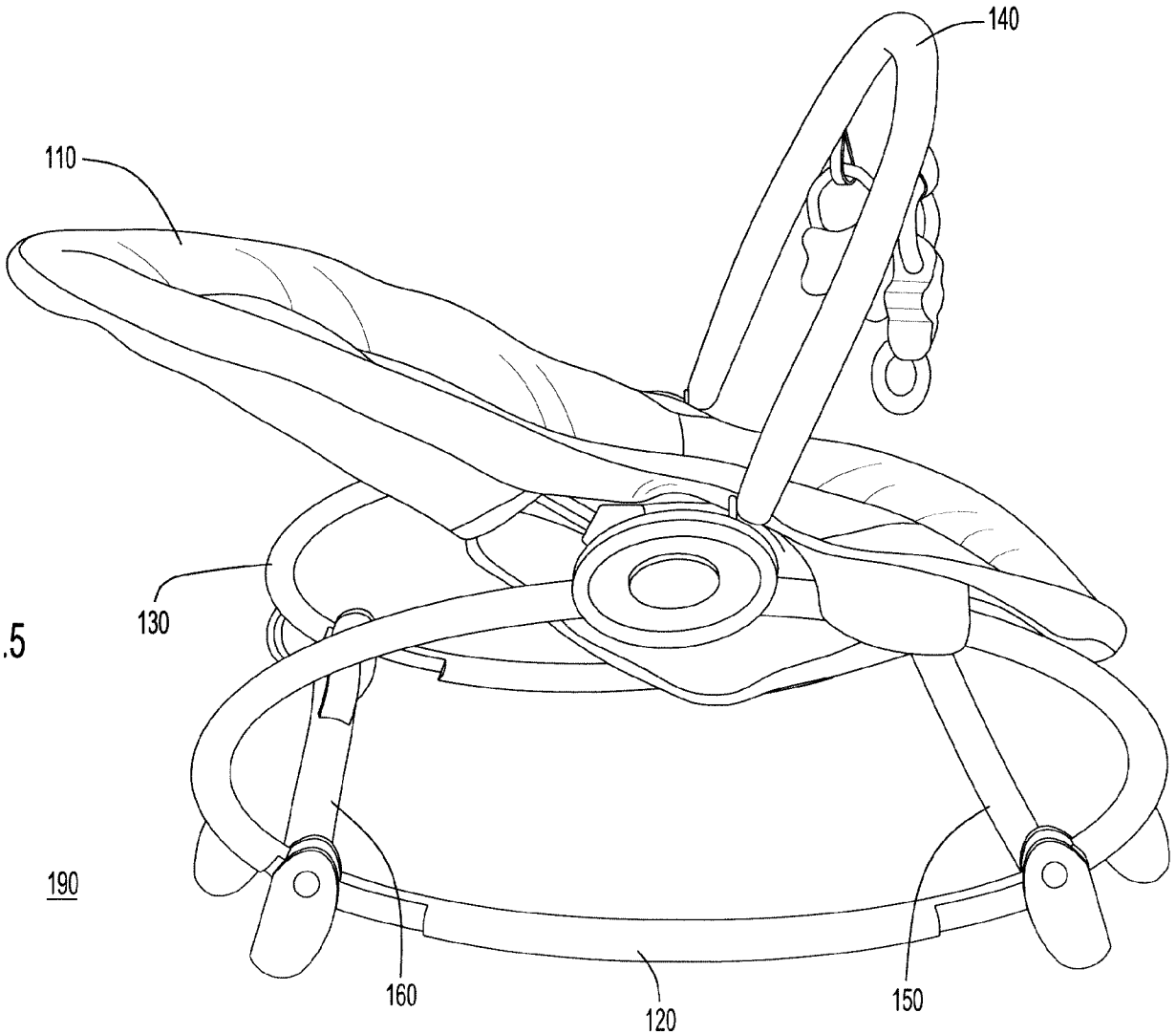
FIG. 5 illustrates a side perspective view of the child receiving device of the present invention in the side-to-side rocker configuration.
Figure 6:
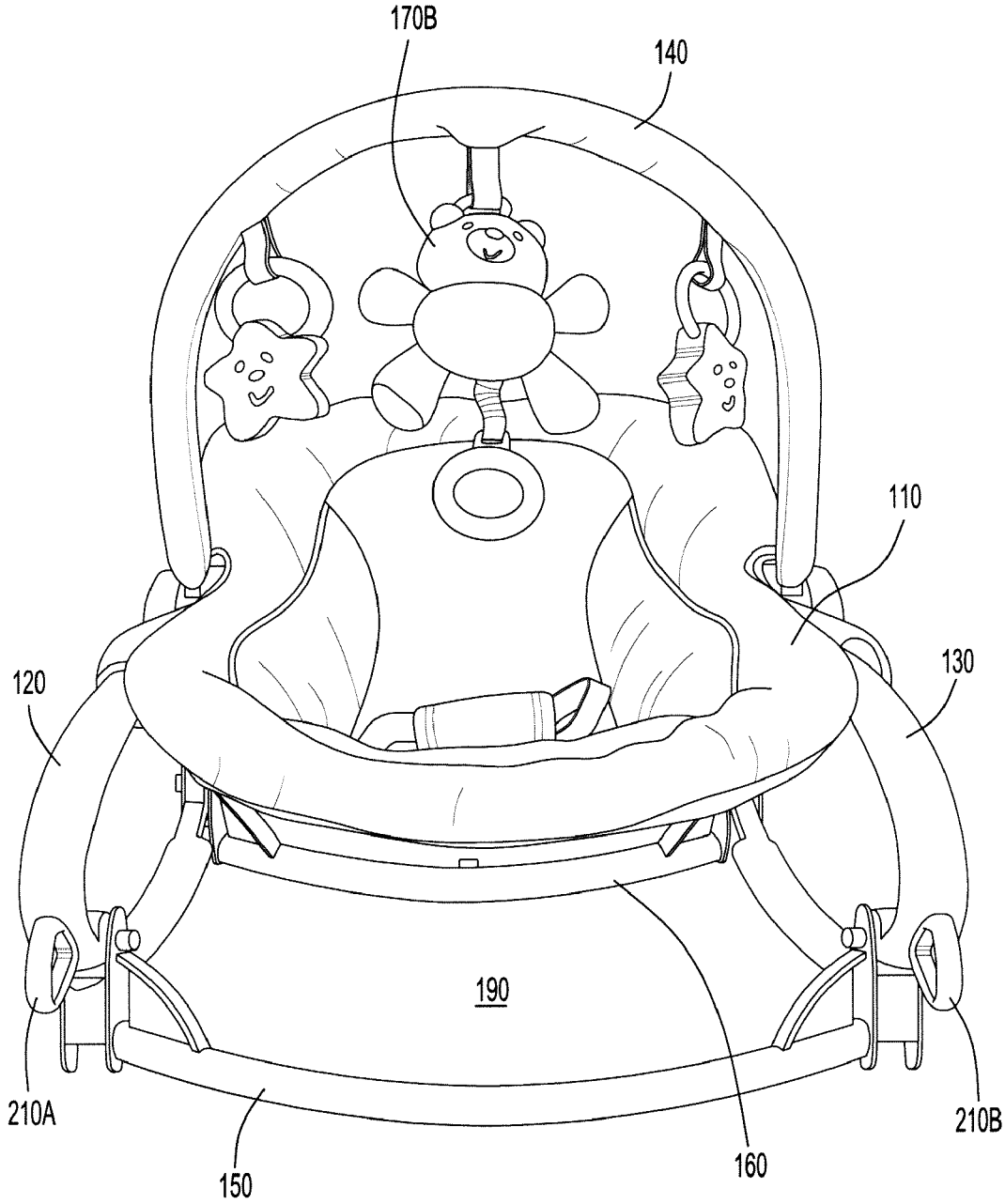
FIG. 6 illustrates a front view of the child receiving device of FIG. 5 in the side-to-side rocker configuration.

The pivotal connections between the cross member first and second ends 151, 152 and 161, 162 and the pivotal leg connectors 121, 131, 122, 132 enable each cross member 150, 160 to be independently pivoted between a first position (shown in FIGS. 1 and 2) and a second position (shown in FIGS. 5 and 6). In addition, each cross member 150, 160 also has an arcuate, supporting surface contacting portion. Each cross rocker 150, 160 may be pivoted such that its arcuate portion is disposed in an upper configuration in the first position and in a lower configuration in the second position.

The individually pivotable feature of the cross members 150, 160 enables the child receiving device 100 of the present invention to easily be converted between a front-to-back rocking configuration, a non-rocking, upright configuration, a non-rocking, reclined configuration, and a side-to-side rocking configuration. In the first, front-to-back rocking configuration, both of the cross members 150, 160 are arranged in the first position so that their arcuate portions are disposed upward (so as to not be in contact with the supporting surface 190). Also in this front-to-back rocker configuration, the arcuate portions of the first and second cross members 150, 160 are positioned above the arcuate portions of the leg members 120, 130. In this first configuration, the arcuate portions of the leg members contact the supporting surface 190 to enable the child receiving device 100, including the seat portion 110, to rock in a front-to-back motion. Furthermore, in the first configuration, left front stop 210A and right front stop 210B limit the rocking motion of the leg members 120, 130 to prevent tipping.

Figure 3:
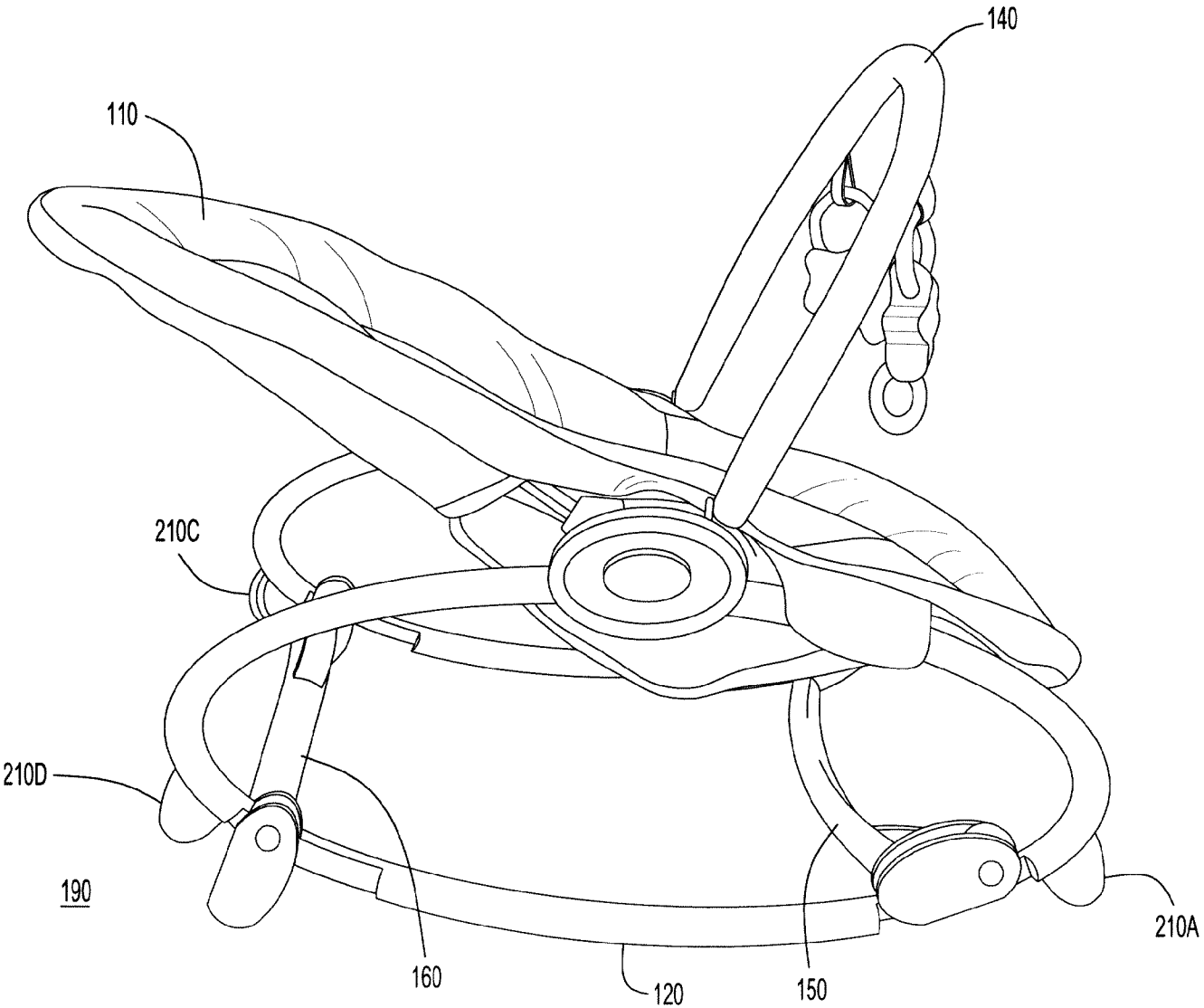
FIG. 3 illustrates a side perspective view of the child receiving device of the present invention in the non-rocker, upright seat configuration.

FIG. 3 illustrates a side perspective view of the child receiving device 100 of the present invention in the non-rocking, upright, configuration. In this second configuration, the second cross member 160 is pivoted downward to its second position such that the acruate portion of the second cross member 160 is disposed below the arcuate portions of the leg members 120, 130 and is in contact with the supporting surface 190. In this second configuration, the second cross member 160 prevents the child receiving device 100 from rocking in a front-to-back motion. In addition, in this second configuration, the second cross member 160 elevates the rear of the child receiving device 100 such that the seat portion 110 is arranged in a generally upright seating position. Furthermore, in this second configuration, the left front stop 210A and right front stop 210B limit or prevent the front to back rocking of the leg members 120, 130.

Figure 4:
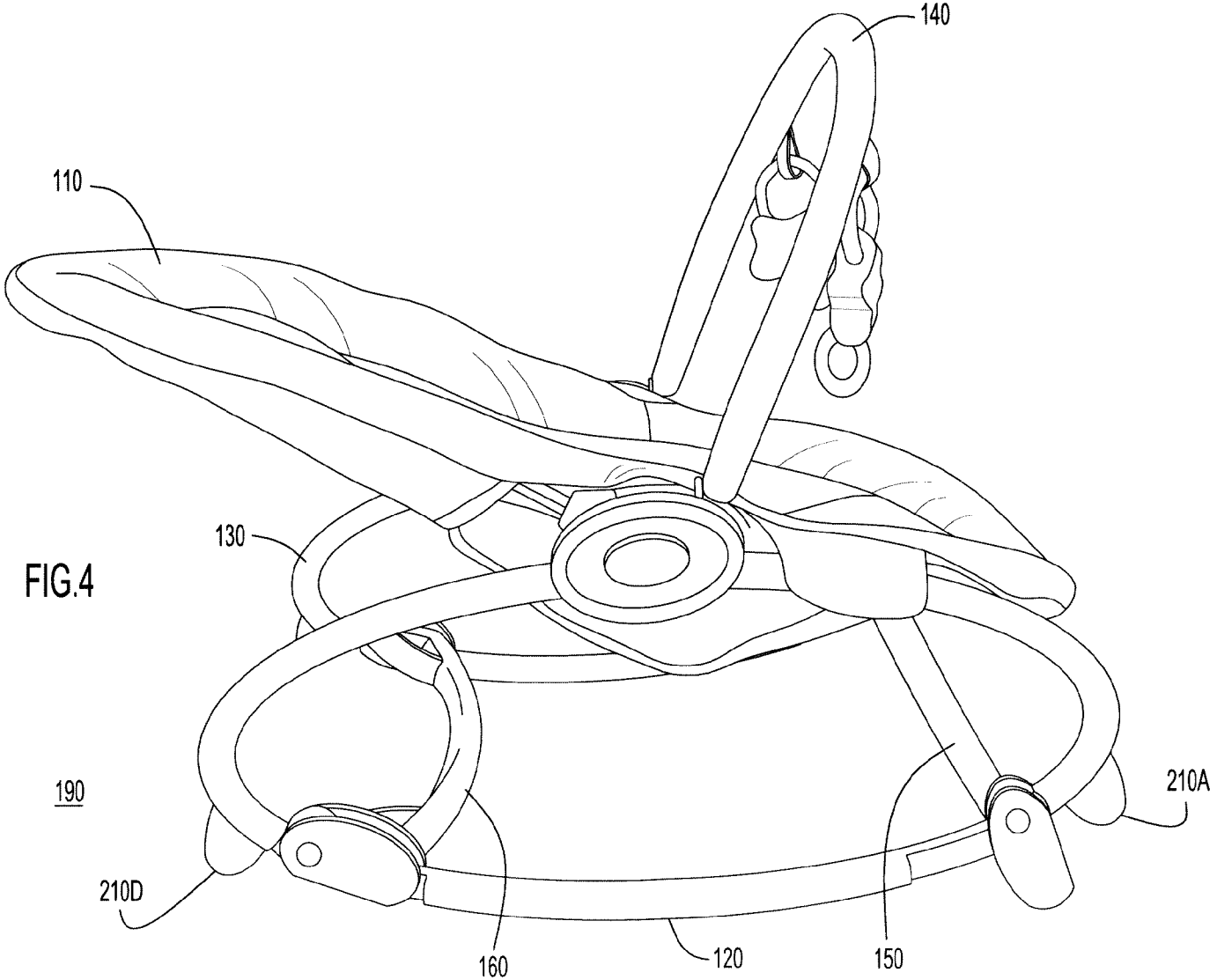
FIG. 4 illustrates a side perspective view of the child receiving device of the present invention in the non-rocker, reclined seat configuration.

FIG. 4 illustrates a side perspective view of the child receiving device 100 of the present invention in the non-rocking, reclined, configuration. In this third configuration, the first cross member 150 is pivoted downward to its first position (while the second cross member 160 is in its second, upper position) such that the acruate portion of the first cross member 150 is disposed below arcuate portions of the leg members 120, 130. In this third configuration, the first cross member 150 prevents the child receiving device 100 from rocking in a front-to-back motion. In addition, in this third configuration, the first cross member 150 elevates the front of the child receiving device 100 such that the seat portion 110 is arranged in a generally reclined position. Furthermore, in this third configuration, the right rear stop 210C and left rear stop 210D limit or prevent front to back rocking of the leg members 120, 130.

FIG. 5 illustrates a side perspective view of the child receiving device 100 of the present invention in the side-to-side rocker configuration. In this fourth, side-to-side rocking configuration, both of the cross members 150, 160 are arranged in the second configuration so that their arcuate portions are disposed in their downward position. In this fourth, side-to-side rocker configuration, the arcuate portions of the first and second cross members 150, 160 are positioned below the arcuate portions of the leg members 120, 130. The arcuate portions of the first and second cross members 150, 160 contact the supporting surface 190 to enable the child receiving device 100, including the seat portion 100, to rock in a side-to-side motion.

FIG. 6 illustrates a front view of the child receiving device 100 of the present invention in the fourth, side-to-side rocker configuration. FIG. 6 clearly shows the first and second cross members 150, 160 contacting the supporting surface 190 and configured to be rocked from side to side. In this configuration, the contacting of the supporting surface 190 by the arcuate portions of the first and second cross members 150, 160 causes the arcuate portions of the leg members 120, 130 to be elevated above the supporting surface 190.

Thus, it is intended that the present invention cover the modifications and variations of this invention that come within the scope of the appended claims and their equivalents. For example, it is to be understood that terms such as "left", "right" "top", "bottom", "front", "rear", "side", "height", "length", "width", "upper", "lower", "interior", "exterior", "inner", "outer" and the like as may be used herein, merely describe points of reference and do not limit the present invention to any particular orientation or configuration. Additionally, even though the child receiving device of the present invention has been described as having multiple arcuate leg members and multiple arcuate cross members, a single, over-sized, leg member and/or a single, over-sized, cross member can be substituted without departing from the scope of the invention. Single members need only be broad enough to ensure that the rocker device will be sufficiently stable during rocking. In the case of a single leg member and a single cross member, the child receiving device would still transform between a front-to-back rocking mode and a side-to-side rocking mode.

We claim:

1. A reconfigurable child rocking device for supporting a child above a supporting surface comprising:

a seat portion including a first, child receiving, side and a second side opposite the first side, the second side facing the supporting surface;

at least one arcuate leg member connected to the seat portion; and at least one arcuate cross member pivotally connected to said at least one arcuate leg member, wherein in a first configuration, said arcuate cross member is positioned above said at least one arcuate leg member and said at least one arcuate leg member is configured to contact said supporting surface to support said seat portion in a rocking manner in a first direction, and wherein in a second configuration said arcuate cross member is pivotally readjusted to be positioned below said at least one arcuate leg member to contact said supporting surface to support said seat portion in a rocking manner in a second direction, said first direction being generally perpendicular to said second direction, and wherein said second side of said seat portion faces the supporting surface in both said first configuration and said second configuration of said child rocking device and while said arcuate cross member is being pivotally readjusted.

2. The reconfigurable child rocking device of claim 1, wherein said at least one arcuate leg member comprises a first arcuate leg member and a second arcuate leg member.

3. The reconfigurable child rocking device of claim 2, wherein said at least one arcuate cross member comprises a first arcuate cross member and a second arcuate cross member.

4. The reconfigurable child rocking device of claim 3, wherein in said first configuration, said first and second arcuate cross members are arranged above said first and second arcuate leg members and said arcuate leg members are configured to contact said supporting surface to support said seat portion in a rocking manner in the first direction.

5. The reconfigurable child rocking device of claim 4, wherein in said second configuration said arcuate cross members are pivotally readjusted to be positioned below said arcuate leg members to contact said supporting surface to support said seat portion in a rocking manner in the second direction.

6. The reconfigurable child rocking device of claim 3, wherein in a third configuration, said second arcuate cross member is pivotally readjusted to be positioned below said first and second arcuate leg members to contact said supporting surface to prevent said reconfigurable child rocking device from rocking in a front-to-back motion on said first and second arcuate leg members.

7. The reconfigurable child rocking device of claim 3, wherein in a fourth configuration, said first arcuate cross member is pivotally readjusted to be positioned below said first and second arcuate leg members to contact said supporting surface to prevent said reconfigurable child rocking device from rocking in a front-to-back motion on said first and second arcuate leg members.

8. The reconfigurable child rocking device of claim 6, wherein in said third configuration, said first arcuate cross member is pivotally adjusted in a position above said first and second arcuate leg members and out of contact with said supporting surface.

9. The reconfigurable child rocking device of claim 7, wherein in said fourth configuration, said second arcuate cross member is pivotally adjusted in a position above said first and second arcuate leg members and out of contact with said supporting surface.

10. The reconfigurable child rocking device of claim 2, wherein each of said first arcuate leg member and said second arcuate leg member include stops to limit the amount of rocking motion of said child rocking device.

11. A reconfigurable child rocking device for supporting a child above a supporting surface comprising:

a seat portion including a first, child receiving, side and a second side opposite the first side, the second side facing the supporting surface;

at least one arcuate leg member connected to the seat portion; and at least one arcuate cross member adjustably connected to said at least one arcuate leg member, wherein in a first configuration, said arcuate cross member is positioned above said at least one arcuate leg member and said at least one arcuate leg member is configured to contact said supporting surface to support said seat portion in a rocking manner in a first direction, and wherein in a second configuration said arcuate cross member is readjusted to be positioned below said at least one arcuate leg member to contact said supporting surface to support said seat portion in a rocking manner in a second direction, said second direction being generally perpendicular to said first direction, and wherein said second side of said seat portion faces the supporting surface in both said first configuration and said second configuration of said child rocking device and while said arcuate cross member is being readjusted.

12. The reconfigurable child rocking device of claim 11, wherein said at least one arcuate leg member comprises a first arcuate leg member and a second arcuate leg member.

13. The reconfigurable child rocking device of claim 12, wherein said at least one arcuate cross member comprises a first arcuate cross member and a second arcuate cross member.

14. The reconfigurable child rocking device of claim 13, wherein in said first configuration, said first and second arcuate cross members are positioned above said first and second arcuate leg members and said arcuate leg members are configured to contact said supporting surface to support said seat portion in a rocking manner in the first direction.

15. The reconfigurable child rocking device of claim 14, wherein in said second configuration said arcuate cross members are readjusted to be positioned below said arcuate leg members to contact said supporting surface to support said seat portion in a rocking manner in the second direction.

16. The reconfigurable child rocking device of claim 13, wherein in a third configuration, said second arcuate cross member is readjusted to be positioned below said first and second arcuate leg members to contact said supporting surface to prevent said reconfigurable child rocking device from rocking in a front-to-back motion on said first and second arcuate leg members.

17. The reconfigurable child rocking device of claim 13, wherein in a fourth configuration, said first arcuate cross member is readjusted to be positioned below said first and second arcuate leg members to contact said supporting surface to prevent said reconfigurable child rocking device from rocking in a front-to-back motion on said first and second arcuate leg members.

18. The reconfigurable child rocking device of claim 16, wherein in said third configuration, said first arcuate cross member is adjusted in a position above said first and second arcuate leg members and out of contact with said supporting surface.

19. The reconfigurable child rocking device of claim 17, wherein in said fourth configuration, said second arcuate cross member is adjusted in a position above said first and second arcuate leg members and out of contact with said supporting surface.

20. The reconfigurable child rocking device of claim 12, wherein each of said first arcuate leg member and said second arcuate leg member includes stops to limit the amount of rocking motion of said child rocking device.

21. The reconfigurable child rocking device of claim 11, wherein said at least one arcuate cross member is pivotally connected to said at least one arcuate leg member.

22. A method of reconfiguring a child rocking device including the steps of:

providing a seat portion including a first, child receiving, side and a second side opposite the first side, the second side facing a supporting surface;

providing at least one arcuate leg member connected to said seat portion;

providing at least one arcuate cross member adjustably connected to said at least one arcuate leg member;

configuring said child receiving device in a first configuration by adjusting said at least one arcuate cross member to a position above said at least one arcuate leg member and thereby rockably supporting said child rocking device on said at least one arcuate leg member in a first rocking direction; and configuring said child receiving device in a second configuration by adjusting said at least one arcuate cross member to a position below said at least one arcuate leg member and thereby rockably supporting said child rocking device on said at least one arcuate cross member in a second rocking direction, said second rocking direction being perpendicular to said first rocking direction, and wherein said second side of said seat portion faces the supporting surface in both said first configuration and said second configuration of said child rocking device and while said arcuate cross member is being adjusted.

* * * * *

UNITED STATES PATENT AND TRADEMARK OFFICE

CERTIFICATE OF CORRECTION

PATENT NO. : 7,506,922 B2
APPLICATION NO. : 11/745543
DATED : March 24, 2009
INVENTOR(S) : Anthony G. Schulte et al.

It is certified that error appears in the above-identified patent and that said Letters Patent is hereby corrected as shown below:

Column 4, line 14, change “acruate” to --arcuate--.

Column 5, line 14, change “acruate” to --arcuate--.

Signed and Sealed this
Twelfth Day of February, 2013

Teresa Stanek Rea
*Acting Director of the United States Patent and Trademark Office*